US005813048A

United States Patent [19]

Thom

[11] Patent Number: 5,813,048

[45] Date of Patent: Sep. 29, 1998

[54] HELMET VISOR RELEASE APPARATUS

[75] Inventor: Ian Graham Thom, Edinburgh, Great Britain

[73] Assignee: GEC-Marconi Avonics (Holdings) Limited, Stanmore, Great Britain

[21] Appl. No.: 679,214

[22] Filed: Jul. 12, 1996

[30] Foreign Application Priority Data

Aug. 1, 1995 [GB] United Kingdom ..... 9515764

[51] Int. Cl.[6] ..... A42B 3/22

[52] U.S. Cl. ..... 2/6.5; 2/424

[58] Field of Search ..... 2/410, 424, 453, 2/6.1, 6.2, 6.3, 6.4, 6.5, 6.6, 6.7, 10, 15, 9

[56] References Cited

U.S. PATENT DOCUMENTS

| | | | |
|---|---|---|---|
| 3,473,166 | 10/1969 | Lobelle | 2/6.5 |
| 4,297,747 | 11/1981 | Nava | 2/424 |
| 4,546,498 | 10/1985 | Fantin | 2/424 |
| 5,584,073 | 12/1996 | Radzelovaga et al. | 2/6.3 |

FOREIGN PATENT DOCUMENTS

| | | | |
|---|---|---|---|
| 481860 | 4/1992 | European Pat. Off. | 2/6.3 |
| 2610484 | 8/1988 | France | 2/424 |
| 982720 | 2/1965 | United Kingdom . | |
| 1005188 | 9/1965 | United Kingdom . | |
| 2 133 275 | 7/1984 | United Kingdom . | |

*Primary Examiner*—Michael A. Neas
*Attorney, Agent, or Firm*—Spencer & Frank

[57] ABSTRACT

A helmet visor release apparatus has a pair of manually actuatable catches, each of the catches including a first portion to be disposed on a helmet; and a second portion to be disposed on a visor of the helmet. The first portion has an arrangement for releasably engaging the second portion, the arrangement for releasably engaging being manually actuatable for releasing the second portion from the first portion thereby releasing a corresponding one of the catches. The apparatus further includes a linkage mechanism connecting the catches to one another and being configured such that manual release of one of the catches causes a release of another one of the catches.

11 Claims, 3 Drawing Sheets

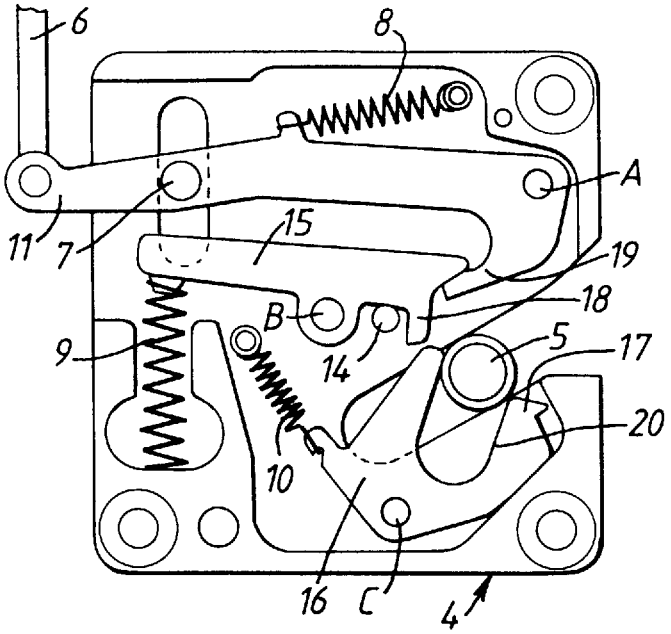
Fig.2a'
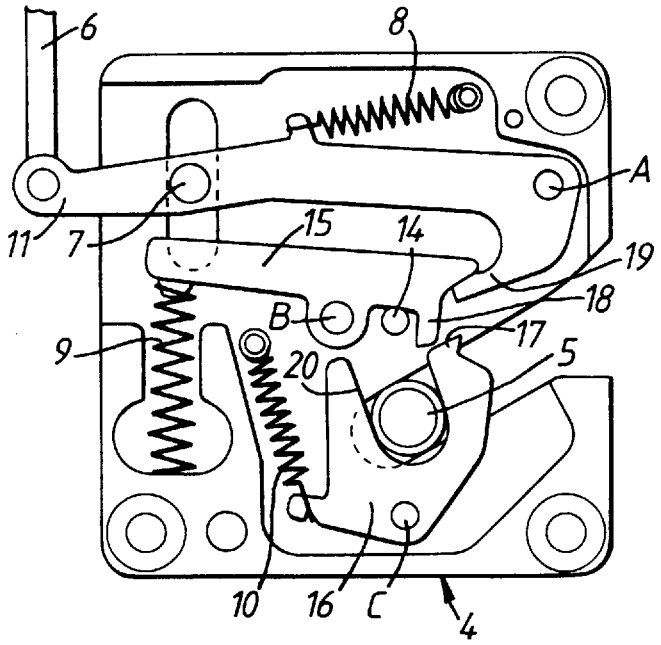
Fig.2a"

HELMET VISOR RELEASE APPARATUS

This invention relates to apparatus for releasing a helmet visor from a secured (closed) position.

BACKGROUND OF THE INVENTION

A helmet visor, when in use, must be held securely in place in front of the user's face in order to protect the user's face and eyes. In the case of a pilot's helmet visor, at least two catches are normally needed to secure the visor in position due to the high 'blast' forces experienced by the pilot upon canopy failure or during ejection. There is a requirement for such visors to be releasable from this secured position so that the visor may be moved away from the user's face when necessary, for example, for the comfort of the user. More particularly in certain applications, for example a combat aircraft pilot's helmet, if the visor is damaged or obscured by a "bird strike" then it must be possible to release the visor immediately so as to avoid obstruction of the user's view which could be fatal.

It has been proposed to attach the uppermost edge of the visor to the helmet by means of a spring-loaded hinge so that the visor may be raised and lowered, and catches have also been proposed so that when lowered, the visor is held securely in place by these catches which are mounted on respective sides of the helmet and visor adjacent to the cheekbone area. It was proposed that the catches be released by means of a lever which is mounted on top of the helmet and connected to the catches by cables. This enables the visor to be released by a single handed operation, which in aircraft application has obvious advantages over a clip mechanism which requires two hands to release it. The spring-loaded hinge then raises the visor out of the user's field of view.

SUMMERY OF THE INVENTION

The invention provides a helmet visor release apparatus comprising two manually operable catches, each catch having a first portion on a helmet arranged to releasably engage with a respective second portion on a visor, and a linkage mechanism connected to both catches such that manual release of one catch causes the other catch to be released.

It has been realised that by employing the present invention the benefits of single handed operation can be achieved without obscuring the wearer's view. It is preferable that the mechanism be such that the visor can be released by opening both the catches manually, thus enabling the visor to still be released even in the event that the linkage mechanism should fail.

Preferably the linkage mechanism is a cable attached to both catches.

The second portion of each catch may be formed as an integral part of the visor, for instance as a lug protruding from the visor.

The invention will now be described, by way of example, with reference to the accompanying drawings, in which:

DETAILED DESCRIPTION OF THE INVENTION

Figure 1:
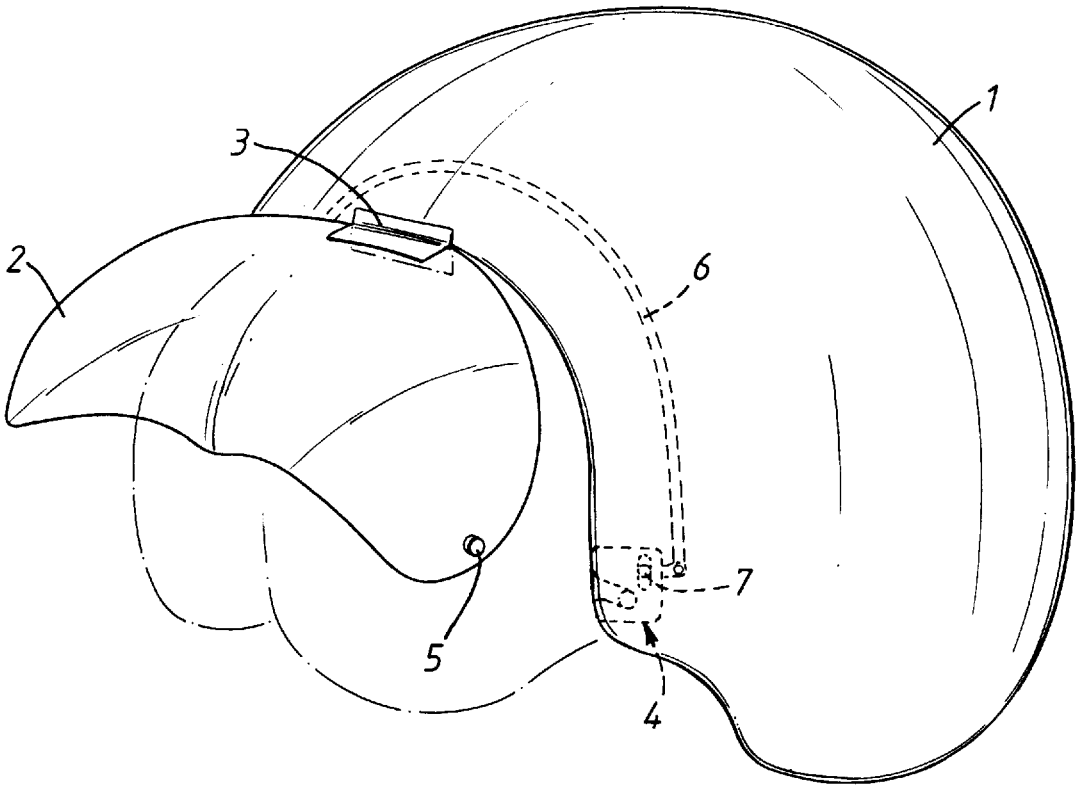
FIG. 1 is a perspective view, partly in section, of a pilot's helmet incorporating apparatus constructed according to the invention.

Referring to FIG. 1, a pilot's helmet, indicated generally by the reference numeral 1, is fitted with a visor 2 by means of a centrally-mounted spring-loaded hinge 3, which biases the visor to a raised position. In order to maintain a lowered position when desired, i.e. in front of the pilot's face, as illustrated by the broken line, the helmet is fitted with two catches each having two portions. The first portion 4 of the catch is incorporated in the helmet 1. The second portion, in this case lug 5, is incorporated on the visor 2 and can be engaged in the first portion 4. The second catch is identical and mounted on the opposite side of the helmet, and for clarity is not shown in FIG. 1. Cable 6 is also incorporated in the helmet 1, and links the first portion 4 of the first catch with the first portion of the second catch.

When the visor 2 is closed, the lugs 5 on the visor are engaged in the first portions 4 of the catches on both sides of the helmet, ensuring that the visor is securely held in front of the pilot's face. When the visor 2 is in this lowered position, the hinge 3 is held in tension. When the visor is no longer required by the pilot, he releases the catch by moving lug 7 downwards which releases lug 5 from first catch portion 4. Movement of lug 7 causes cable 6 to pull upwardly on the other catch, causing the visor lug on the other side of the visor to be released from the catch portion mounted on the helmet. Thus the visor 2 is released and the spring in the hinge 3 raises the visor out of the pilot's field of view by operation of the single catch. If, when the visor 2 is in the lowered position, the other catch is released manually, the cable 6 causes the first catch to be released and hence the visor is released in an identical fashion to that described above. Thus, manual release of either catch releases the visor.

Figure 2A:
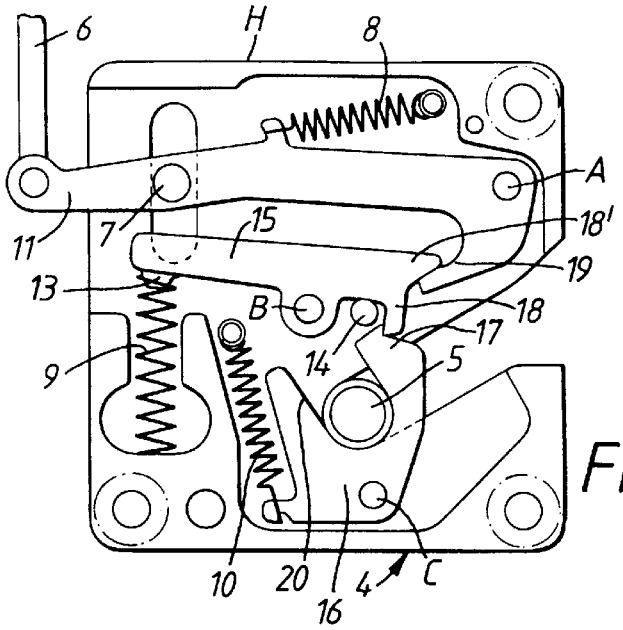
FIGS. 2*a*, 2*a*', 2*a*", 2*b* and 2*c* show a section through a catch of the apparatus illustrated in FIG. 1.

A catch is shown in greater detail in FIG. 2*a*. In this figure the visor (not shown) has been lowered into position and hence lug 5 on the visor is engaged in the first portion 4 of the catch which is incorporated in the helmet (not shown). This portion of the catch is held in tension by springs 8, and 10 mounted on housing H of catch 4. Lever 11 has cable 6 attached to it which connects this catch with the lever on the second catch on the opposite side of the helmet. Affixed to the lever is lug 7 which is constrained to move either up or down. Lug 7 protrudes from the helmet so that it may conveniently be moved manually and movement of this lug causes lug 5 to be released from the first catch portion 4, as shown in FIGS. 2*b*(lug 7 moved downwards) and 2*c*(lug 7 moved upwards).

As shown in FIG. 2*a*, compression spring 9 exerts a turning moment on lever 15 about pin B, causing lever 15 to abut pin 14. Lever 15 includes a first lip 18 at one end thereof which engages a corresponding lip 17 on hollowed lever 16. A second lip 18' at the one end of lever 15 engages a corresponding lip 19 on lever 11. Thus, lever 15 is effective for keeping levers 11 and 16 in their engaged positions, levers 11 and 16 thus placing corresponding springs 8 and 10 under tension.

Figure 2B:
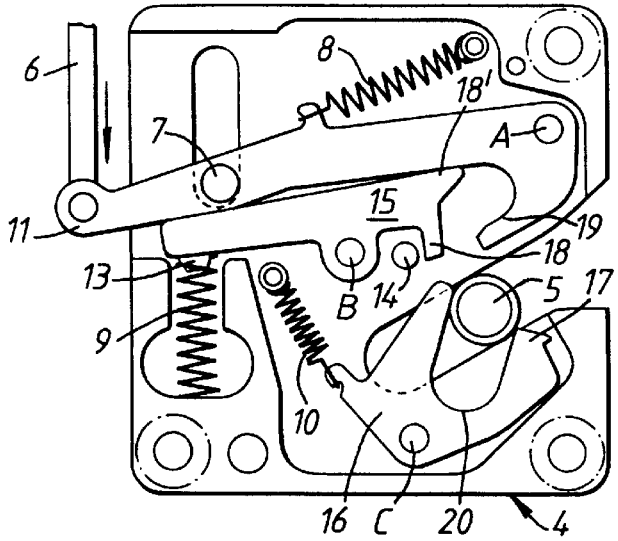
Figure 2C:
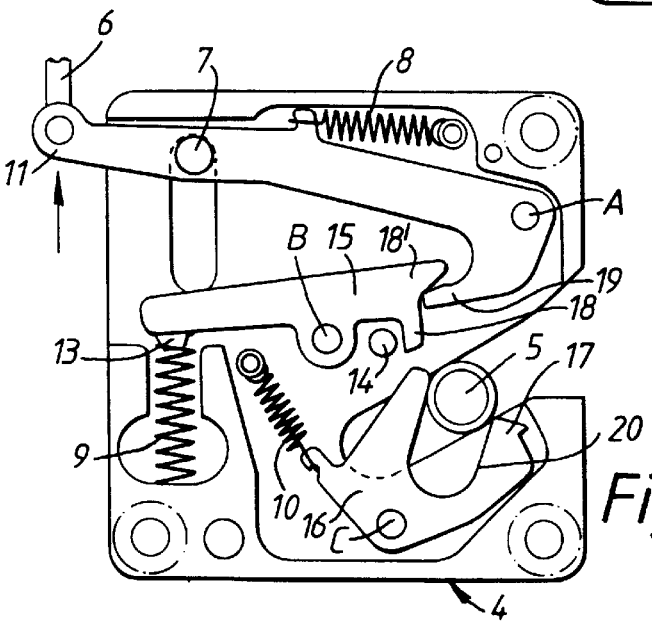

In order to release catch 4, lug 7 attached to lever 11 may be manually moved downward or upward, as shown in FIGS. 2*b* and 2*c* respectively.

Referring to FIG. 2*b*, when lug 7 is moved downward, lever 11 rotates about pin A and pushes down upon lever 15, causing the same to pivot about pin B and to compress compression spring 9, thus raising the one end of lever 15 which includes lips 18 and 18'. The above movement leads to a disengagement of levers 11 and 16 from lever 15. As a result, the only force acting on lever 16 is from tension spring 10, which pulls lever 16 toward itself, thus causing the same to rotate about pin C in a clockwise direction such that lug 5 is released from hollow 20 in the lever.

Referring to FIG. 2*c*, when lug 7 is moved upward, lever 11 rotates about pin A and causes its lip 19 to pull up lip 18' of lever 15, lever 15 thus pivoting about pin B and compressing compression spring 9. The above movement leads to a disengagement of lever 16 from lever 15. Thus, similar to FIG. 2*b*, lever 16 rotates about pin C in a clockwise direction such that lug 5 is released from hollow 20 therein.

Once lug 7 is released (and hence after lug 5 is released from hollow 20), levers 11 and 15 resume their positions shown in FIG. 2*a* by virtue of the force exerted thereon by springs 8 and 9, respectively, as shown in FIG. 2*a*'. For locking the visor into catches 4, by pushing the same down upon the catches, lug 5 lodges itself into hollow 20 of lever 16, and causes lever 16 to rotate about pin C in a counter-clockwise direction, thus placing spring 10 under tension, as shown in FIG. 2*a*". As seen in FIGS. 2*a*–2*c*, lip 17 on lever 16 has a slanted end, similarly to lip 18 on lever 11. It is clear that, by pushing lug 5 further into catch 4, the slanted ends of lips 17 and 18 slide upon one another as suggested in FIG. 2*a*"until lips 17 and 18 engage one another, as shown in FIG. 2*a*.

Referring to FIG. 2*b*, if lug 7 is moved downwards, lever 11 also pulls cable 6 downwards. Hence the corresponding lever on the first portion of the second catch will be pulled upwards by cable 6. The second catch will then assume the position of FIG. 2*c*. Therefore, manual release of the first catch produces automatic release of the second catch. Similarly, manual release of the second catch automatically releases the first catch.

Should the cable 6 break, both catches may be released manually, by moving both respective lugs 7 either up or down permitting the visor to be raised as before.

Variations may be made without departing from the scope of the invention for instance, the catches need not be linked by a cable; hydraulic, electronic or other suitable linkage means may be employed.

I claim:

1. A helmet visor release apparatus comprising:

a pair of manually actuatable catches, each of the catches having:

a first portion adapted to be disposed on a helmet; and a second portion adapted to be disposed on a visor of the helmet, the first portion having means for releasably engaging the second portion, the means for releasably engaging being manually actuatable at said each of the catches for releasing the second portion from the first portion thereby releasing said each of the catches; and a linkage mechanism connecting the catches to one another and being configured such that manual release of one of the catches causes a release of another one of the catches.

2. The helmet visor release apparatus according to claim 1, wherein the linkage mechanism comprises a cable.

3. The helmet visor release apparatus according to claim 1, wherein the means for releasably engaging corresponding to each of the catches and the linkage mechanism are configured such that manual release of either one of the catches causes a release of another one of the catches.

4. The helmet visor release apparatus according to claim 1, wherein:

the first portion of each of the catches includes a housing;

the means for releasably engaging corresponding to each of the catches includes:

a first pivotable lever mounted on the housing;

a second pivotable lever mounted on the housing adjacent the first pivotable lever and being releasably engageable by the first pivotable lever, the first pivotable lever and the second pivotable lever thereby being adapted to assume respective engaged positions;

means for pivotably biasing the first pivotable layer and the second pivotable layer into their respective engaged positions;

a third pivotable lever mounted on the housing adjacent the second pivotable lever and being releasably engageable by the second pivotable lever thereby being adapted to assume an engaged position, the third pivotable lever defining a hollow and further being adapted to assume a receiving position in which the hollow receives the second portion of said each of the catches therein, the third pivotable layer further being configured such that manually pressing the second portion of said each of the catches therein pivots the third pivotable layer into its engaged position thereby causing the first pivotable lever of said each of the catches to releasably engage the second pivotable lever of said each of the catches; and means for pivotably biasing the third pivotable lever into its receiving position.

5. The helmet visor release apparatus according to claim 4, wherein:

the means for pivotably biasing the first pivotable layer and the second pivotable layer includes:

a tension spring attached to the housing at one end thereof and to the first pivotable layer at another end thereof; and a compression spring attached to the housing at one end thereof and to the second pivotable layer at another end thereof; and the means for pivotably biasing the third pivotable layer includes a tension spring attached to the housing at one end thereof and to the third pivotable layer at another end thereof.

6. The helmet visor release apparatus according to claim 1, wherein the first portion includes a lug for manually releasing the second portion from the first portion thereby releasing said each of the catches.

7. The helmet visor release apparatus according to claim 1, wherein the lug is configured such that a manual movement of the lug in both an upward and a downward direction releases said each of the catches.

8. A combination including:

a helmet;

a visor attached to the helmet; and a helmet visor release apparatus comprising:

a pair of manually actuatable catches, each of the catches having:

a first portion disposed on the helmet; and a second portion adapted to be disposed on a visor of the helmet, the first portion having means for releasably engaging the second portion, the means for releasably engaging being manually actuatable at said each of the catches for releasing the second portion from the first portion thereby releasing said each of the catches; and a linkage mechanism connecting the catches to one another and being configured such that manual release of one of the catches causes a release of another one of the catches.

9. The combination according to claim 8, wherein the second portion is formed as an integral part of the visor.

10. The combination according to claim 8, further comprising a hinge mounted on an upper portion of the visor and securing the visor to the helmet, the hinge having a resilient mechanism for urging the visor to an open position upon release of the pair of catches, wherein:

the first portion is disposed on the helmet adjacent a cheek area thereof; and the second portion is disposed on the visor adjacent a cheek area thereof.

11. The combination according to claim 8, wherein the helmet is a pilot's helmet.

* * * * *